US005386270A

United States Patent [19]

Housel

[11] Patent Number: 5,386,270

[45] Date of Patent: Jan. 31, 1995

[54] ELECTROSTATOGRAPHIC REPRODUCTION APPARATUS WITH ANNOTATION FUNCTION

[75] Inventor: Edward M. Housel, Gates, N.Y.

[73] Assignee: Eastman Kodak Company, Rochester, N.Y.

[21] Appl. No.: 525,928

[22] Filed: May 21, 1990

[51] Int. Cl.[6] ..... G03G 21/00

[52] U.S. Cl. ..... 355/202; 355/218; 355/244

[58] Field of Search ..... 355/202, 218, 244, 243, 355/75

[56] References Cited

U.S. PATENT DOCUMENTS 4,417,805 11/1983 Kishi ..... 355/243 X
4,640,601 2/1987 Deguchi et al. ..... 355/218
4,707,121 11/1987 Sawaki et al. ..... 355/75 X
4,740,818 4/1988 Tsilibes et al. .
4,763,165 8/1988 Watanabe ..... 355/218 X
4,777,510 10/1988 Russel ..... 355/218 X
4,791,450 12/1988 Mosehauer et al. .
4,794,421 12/1988 Stoudt et al. .
4,887,128 12/1989 Jamali et al. ..... 355/202
4,943,833 7/1990 Fukushima ..... 355/218 X

*Primary Examiner*—A. T. Grimley
*Assistant Examiner*—Shuk Y. Lee
*Attorney, Agent, or Firm*—Norman Rushefsky

[57] ABSTRACT

An electrostatographic reproduction apparatus includes a digitizing tablet for designating an area to receive an annotation on reproductions of a document sheet original. An annotation stored electronically in the apparatus is printed using an electronic writer and the size of the annotation printed on a copy sheet is scaled approximately to the designated area.

9 Claims, 6 Drawing Sheets

ELECTROSTATOGRAPHIC REPRODUCTION APPARATUS WITH ANNOTATION FUNCTION

BACKGROUND OF THE INVENTION

1. Field of the Invention

The present invention relates to electrostatographic reproduction apparatus and more specifically to the reproduction of originals with additional annotations.

2. Brief Description of the Prior Art

In the prior art, electrophotographic reproduction apparatus are known wherein copies of originals may be made and selective additional information provided to such copies. With reference to FIG. 1, a document, D, to be copied is to have copies thereof annotated with for example the words "TOP SECRET" provided at a suitable location on the copies but such words do not appear on the original. Quite often in annotating a document for reproduction, the location and size of the annotation on the copy is important so as not to obscure other information on the original. In U.S. Pat. No. 4,640,601 there is disclosed electrophotographic apparatus for producing annotated copies. Various methods are proposed for changing the size of the additional information such as by changing the scanning frequency and/or luminous pulse width of an LED writer array while rotating a photosensitive drum at a constant speed and/or by changing the speed of the drum. Such changes in size of the additional information are implemented in response to a magnification change which changes the size of the original as well. Such a change in the size of the original is frequently not desired.

It is therefore an object of the invention to provide electrostatographic reproduction apparatus that provides change of magnification of annotated subject matter without changing the magnification of the original.

It is further an object of the invention to provide electrostatographic reproduction apparatus that provides for improved means for designating magnification changes of annotations relative to space available on the original.

SUMMARY OF THE INVENTION

In accordance with the invention, there is provided an electrostatographic reproduction apparatus comprising:

- means for designating an area on an original to be reproduced with an annotation;
- means for storing data to be used to form an annotation;
- means for scaling the data to a size related to a dimension parameter of the area and generating a signal representing same;
- an electrostatic recording element;
- means for modulating charge on the recording element with image information from an original document to be reproduced;
- means responsive to said signals for modulating charge on the recording element to record the annotated information;
- means for developing the information recorded on the recording element; and
- means for transferring the recorded information to a copy sheet to form a reproduction of the original document with an annotation in the area corresponding to that designated and of a size related to a dimension parameter of the area.

DETAILED DESCRIPTION OF THE PREFERRED EMBODIMENTS

Because electrostatographic reproduction apparatus are well known, the present description will be directed in particular to elements forming part of or cooperating more directly with the present invention. Apparatus not specifically shown or described herein are selectable from those known in the prior art.

Figure 2:
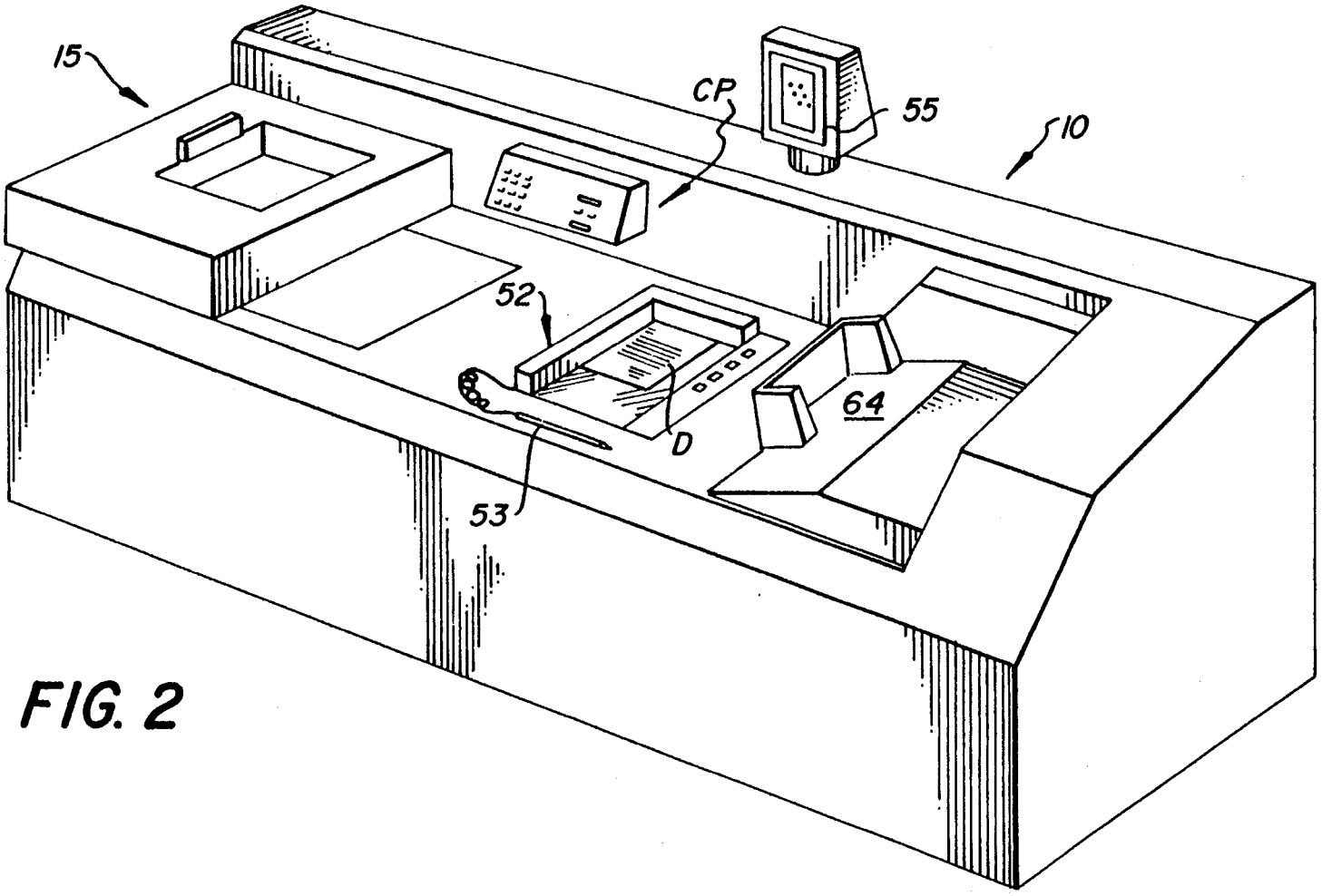
FIG. 2 is a perspective view of a reproduction apparatus made in accordance with the invention.
Figure 3:
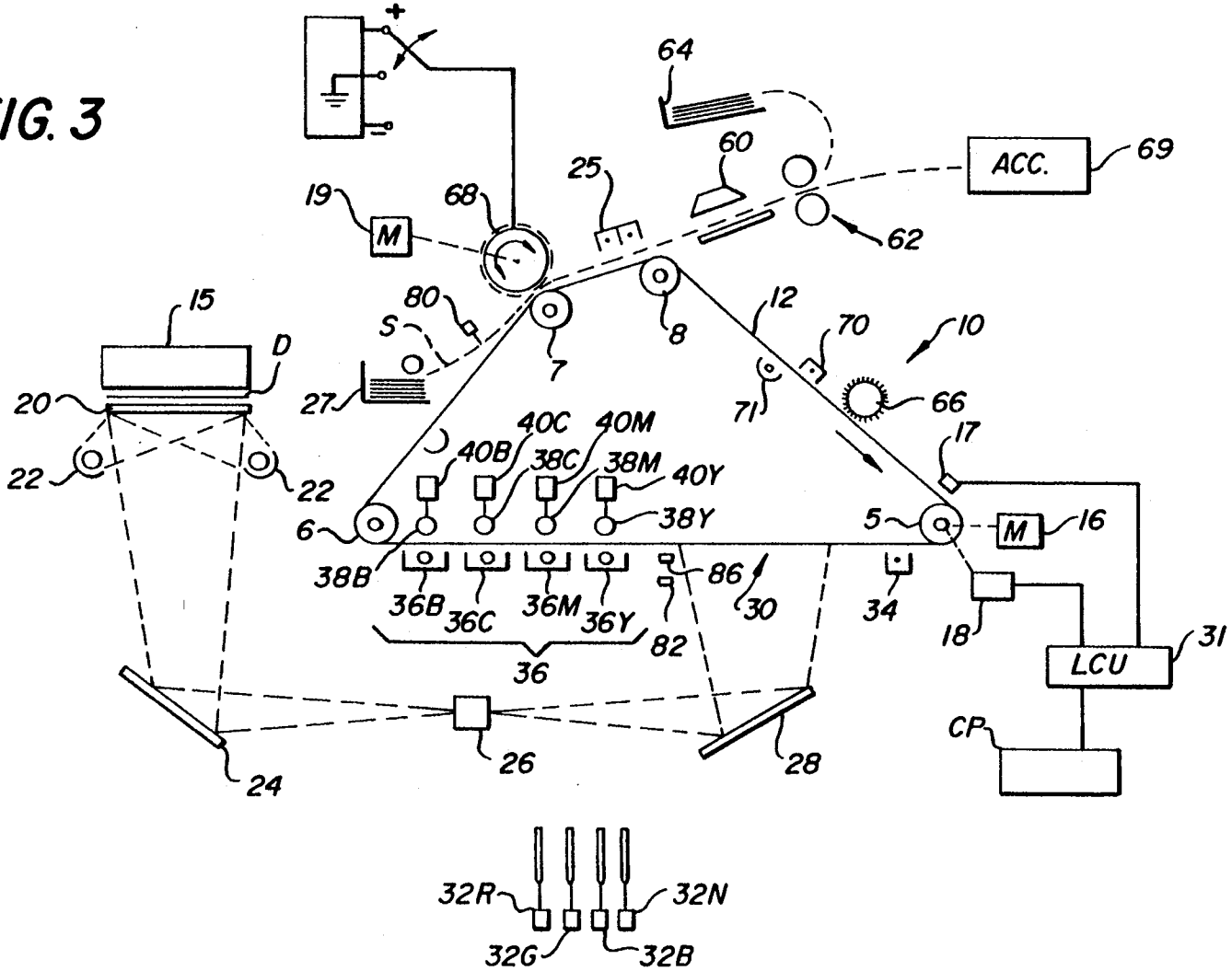
FIG. 3 is a schematic of the operating elements of the apparatus of FIG. 2.
Figure 4:
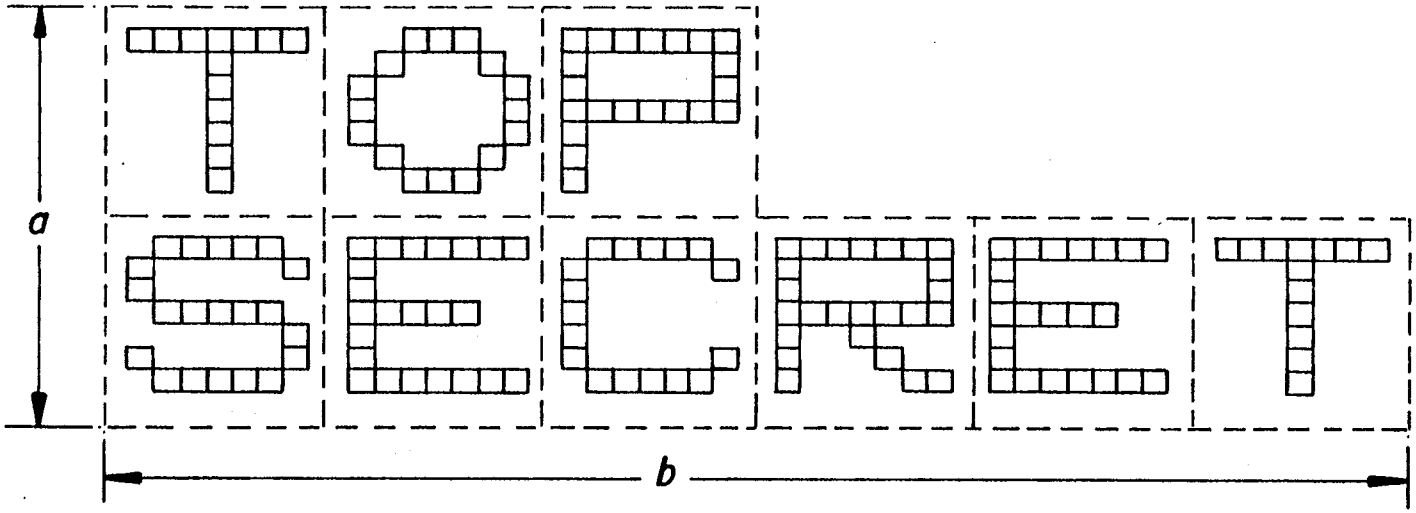
FIG. 4 is a visualization of an elementary unit bit map illustrating the additional information.

With reference now to FIG. 2 and 3, a four color multicolor electrophotographic reproduction apparatus is shown.

The apparatus 10 includes a closed loop, flexible image transfer member, or photoconductive web 12. The web 12 is supported on rollers 5–8. The rollers are mounted on the copier frame (not shown) with one of the rollers, for example roller 5, rotatively driven by a motor 16 to effect continuous movement of the web 12 in a clockwise direction about its closed loop path. The web has a plurality of sequentially spaced, nonoverlapping image areas which pass successively through electrophotographic processing stations (charge, expose, develop, transfer, clean) located about the path of the web. The web also includes timing marks (or regularly spaced perforations) which are sensed by appropriate means, such as timing signal generator 17 to produce timing signals. Such signals are sent to a computer controlled logic and control unit 31. The LCU 31 controls the entire electrophotographic process based on the instantaneous location of the web in the travel path. An encoder 18 associated with the roller drive motor 16 also produces timing signals for the LCU. The signals from the encoder cause the LCU to fine tune the process timing. The LCU 31 has a digital computer, preferably a microprocessor. The microprocessor has a stored program responsive to the input signals for sequentially actuating, then de-actuating the work stations as well as for controlling the operation of many other machine functions.

Programming of a number of commercially available microprocessors is a conventional skill well understood in the art. This disclosure is written to enable a programer having ordinary skill in the art to produce an appropriate control program for the microprocessor. The particular details of any such program would, of course, depend on the architecture of the designated microprocessor.

Figure 5:
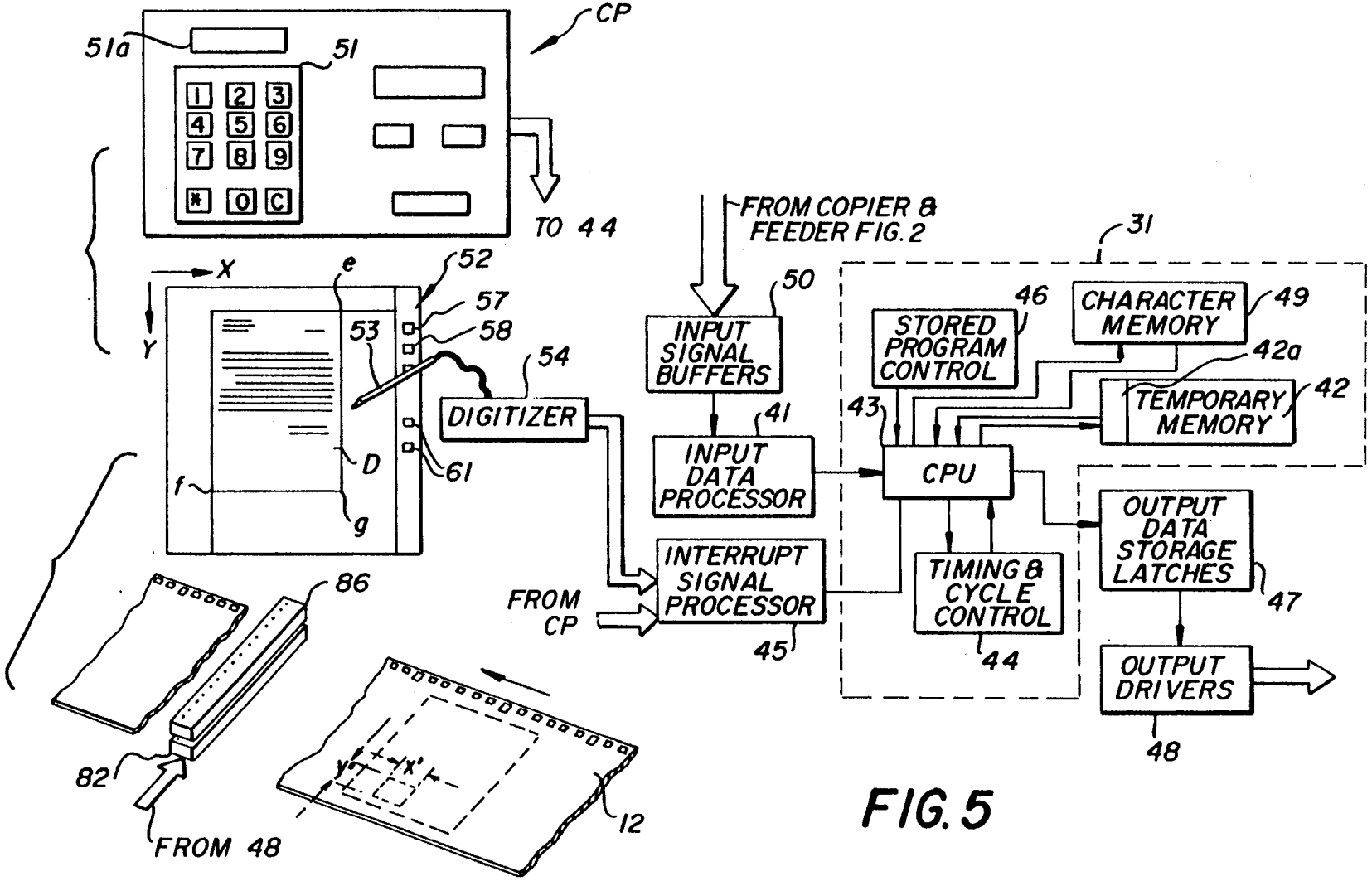
FIG. 5 is a schematic illustrating a data input station and block diagrams of controls for controlling the apparatus shown in FIGS. 2 and 3.
Figure 6:
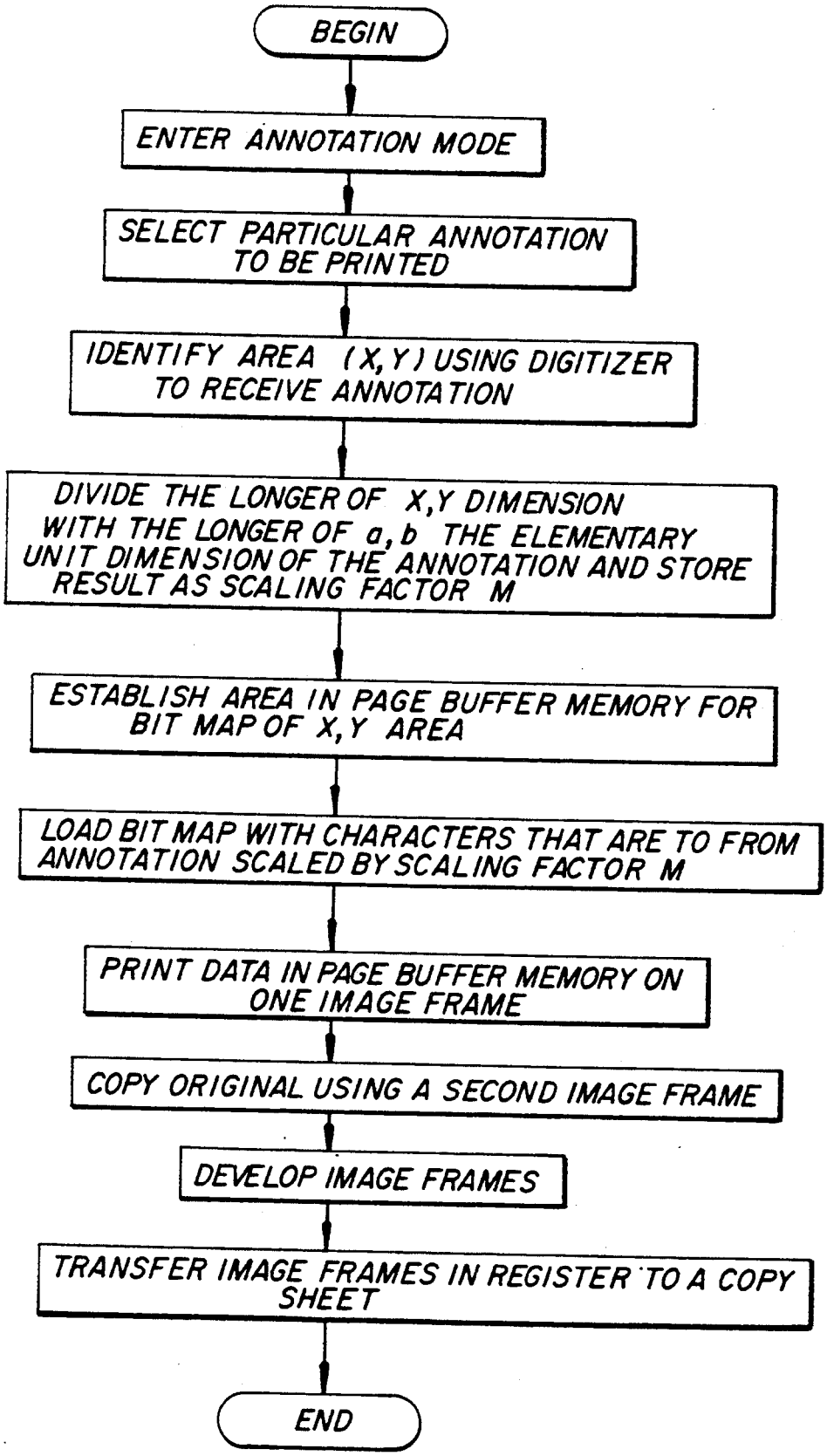
FIG. 6 is a flowchart illustrating the steps for reproducing an annotated document in accordance with the invention.

With reference also now to FIG. 5, a block diagram of logic and control unit (LCU) 31 is shown which interfaces with the apparatus 10. The LCU 31 comprises temporary data storage memory 42 that includes a page memory portion 42*a*, central processing unit 43, timing and cycle control unit 44, stored program control 46 and character memory 49 for storing elementary bit maps of the available annotations. Data input and output are performed sequentially under program control. Input data are applied either through input signal buffers 50 to a input data processor 41 or to interrupt signal processor 45. The input signals are derived from various switches, sensors, and analog-to-digital converters. The output data and control signals are applied to storage latches 47 which provide inputs to suitable output drivers 48, directly coupled to leads. These leads are connected to the various work stations, mechanisms and controlled components associated with the apparatus.

Before discussing reproduction of document D, the apparatus will first be described with reference to reproduction of a multicolored original document. A multicolored original document sheet to be reproduced is placed, image side down, on a transparent glass platen 20 supported by the copier frame. Exposure lamps 22, such as xenon flash tubes, are located beneath the platen 20 within the frame. The lamps flood the document sheet with light and a reflected image of the document sheet is transmitted via mirror 24, lens 26, and mirror 28 in focus to an area 30 lying in the plane of the web 12. The original document could, of course, be a transparency illuminated from the back side thereof. To reproduce an ordinary multicolored document in its original colors, the document sheet is illuminated, for example, four times in succession to form four separate electrostatic latent image frames of the document. On successive illuminations a red filter 32R, a green filter 32G, or a blue filter 32B is inserted into the light path to form color separation images at the area 30. A fourth filter comprising a neutral density filter 32N for providing what is known as a skeletal black image is inserted during a fourth exposure of the original or may be used for coloring areas to be developed in black. The timing of the flash of lamps 22 and the insertion of the colored filters are controlled by the LCU and related to the travel of the web 12 to expose adjacent, nonoverlapping areas of the web to the color separation images and the skeletal black image. One or more corona charging units, exemplified by corona charger 34, is located upstream of the exposure area 30, and applies a generally uniform primary electrostatic charge, of say negative polarity, to the web 12 as it passes the charger and before it enters the exposure area. A programmable power supply may be provided to selectively apply to each image frame a predetermined generally uniform electrostatic primary charge level Vo suitable for developing the particular color toner used to develop that image frame. The photoconductive properties of the web cause the primary charge in the exposed areas of the web to be discharged in that portion struck by the exposure light. This forms latent imagewise charge patterns on the web in the exposed areas corresponding to the respective black and color separation images. Travel of the web then brings the areas bearing the latent images into a development area 36. The development area has a plurality of magnetic brush development stations, corresponding to the number of formed black and color separation images, in Juxtaposition to, but spaced from, the travel path of the web. Magnetic brush development stations are well known; for example, see Fritz et al U.S. Pat. No. 4,473,029 and Miskinis et al 4,546,060. When the color separation images are red, green, blue and a skeletal black image is also to be provided, there are four development stations respectively containing complementary colored toner particles, i.e., cyan particles in station 36C, magenta particles in station 36M, yellow particles in station 36Y, and black particles in station 36B. The toner particles are agitated in the respective developer stations to exhibit a triboelectric charge of opposite polarity to the latent imagewise charge pattern. Backup rollers 38C, 38M, 38Y, and 38B, located on the opposite side of web 12 from the development area, are associated with respective developer stations 36C, 36M, 36Y and 36B. Actuators 40C, 40M, 40Y and 40B selectively move respective backup rollers into contact with the web 12 to deflect the web from its travel path into operative engagement with respective magnetic brushes. The charged toner particles of the engaged magnetic brush are attracted to the oppositely charged latent imagewise pattern to develop the pattern.

The logic and control unit 31 selectively activates the actuators in relation to the passage of the image areas containing corresponding latent color separation images through the development area 36. That is, as the area containing the latent red color separation image reaches the development station 36C, actuator 40C moves the backup roller 38C to deflect the web so that the latent charge image is developed by attracting cyan toner particles from the station 36C. As soon as the image area leaves the effective development area of the station 36C, the actuator 40C returns the backup roller 38C to its nondeflecting position. Thus, as the areas containing the green and blue color separation images and the neutral density latent image pass the developer station 36C, no development takes place. A similar cycle is accomplished by the logic and control unit 31 for the developer stations 36M, 36Y and 36B. In this manner, the red latent color separation image is developed only with cyan toner particles, the green latent color separation image is developed only with magenta toner particles, the blue latent color separation image is developed only with yellow toner particles, and the neutral density latent image is developed only with black toner.

The developed black and color separation images must be transferred to a receiver sheet in accurately registered superimposed relation to form a full color reproduction of the original document. Apparatus for providing such registered transfer are known, for example one of which is fully described in U.S. Pat. No. 4,477,176, issued Oct. 16, 1984 in the name of Matthew J. Russel. Briefly, this is accomplished by feeding a receiver sheet S from a supply stack stored in hopper 27 in synchronism with movement of the first image sector so that the copy sheet engages the web and is registered by mechanism 80 with the first image frame. A transfer roller 68 includes a compliant insulating surface thereon and is biased to a potential suitable for transfer of the developed image on the first image sector to the copy sheet S and to tack copy sheet S to roller 68. Roller 68 is driven by a stepper motor 19 which receives actuating signals from the LCU 31.

Roller 68 may also be a biased vacuum roller or a roller with sheet clamping mechanisms to clamp the sheet to it.

Continued movement of web 12 and synchronized rotation of roller 68 brings the lead edge of copy sheets back into transferable relationship with the web as the lead edge of the next toner image arrives at roller 68. At this point, sheet S remains tacked to roller 68 and the second toner image is transferred in superimposed registration with the first toner image on sheet S. The process is repeated until toner images on each of the first three image sectors have been transferred to the same surface of sheet S and the leading edge of copy sheet has been brought back into transferable relationship with the fourth toner image on the web. When the lead edge of copy sheet S is brought back into transferable relationship with web 12 for the last time, the bias on roller 68 is reversed to repel sheet S away from roller 68 back into contact with web 12. Copy sheet S will be carried by web 12 so that the copy sheet is in registration with the image on the fourth image sector. This image is transferred to the copy sheet by transfer charger 25. The copy sheet is separated from the web and conveyed by vacuum transport 60 or an air transport to roller fuser 62 where the transferred images are then fixed or fused onto the sheet. The sheet is then delivered to exit hopper 64 or an accessory finishing unit 69. While the image is being fixed to the receiver sheet, the web 12 continues to travel about its path and proceeds through a cleaning area 66.

To facilitate toner removal from the web, a corona charging station 70 and a rear erase lamp 71 may be located upstream of the cleaning unit 66 to neutralize any charge remaining on the web and thus reduce the adherence forces of the toner to the web.

Where the original is say a black only original and it is desired to reproduce same in black only, one image frame need be exposed and developed for reproducing Just the information on the original document.

Figure 1:
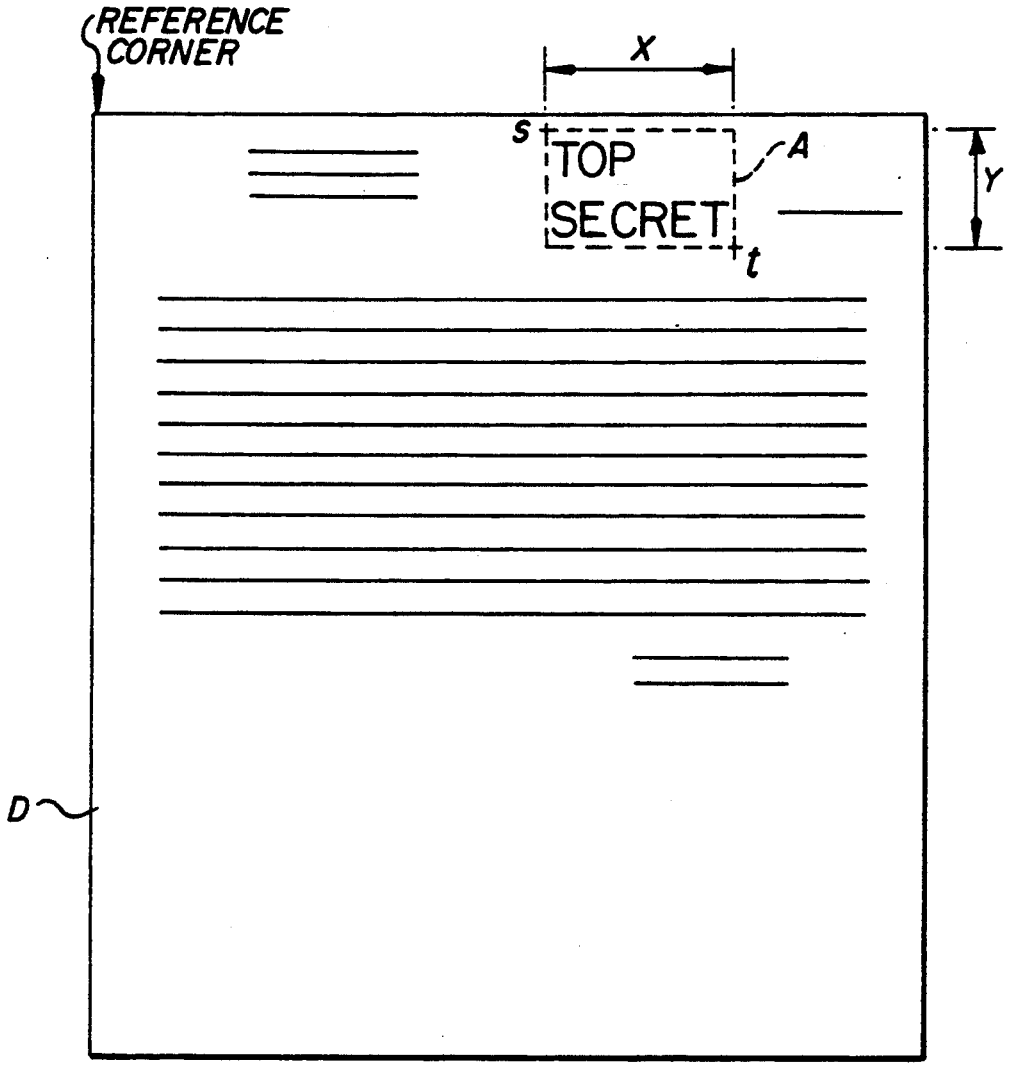
FIG. 1 is a sketch of an original document indicating an area to receive additional information.

In order to reproduce a document sheet such as document sheet D (see FIG. 1) with additional information not present on the original such as the words "TOP SECRET" in the area A having dimensions X, Y of document D, the document sheet D is placed face up on a digitizing tablet 52 and registered against an appropriate corner (or centered relative to a predetermined edge) as shown in FIG. 5. By pressing certain numerical buttons on the keyboard 51 of a control panel CP, which may be preceded by pressing a star button, an annotation mode may be called up as indicated on display 51*a*. Alternatively, a dedicated button for accessing this mode may be provided. In the annotation mode, the display outputs the various annotations that have been stored. From this display the operator uses the numerical buttons to select the desired annotation by scrolling through various options indicated on the display. A wand 53 is associated with the tablet and used by the operator to determine the format of the original and the location and size of the area to receive the annotated image information. Assuming line-type information on the original document sheet D is in black and that the reproduction desired requires the annotation to be in a different color the operator calls up a special program for accomplishing this task via numerical inputs of a code on the keyboard 51 which may be first accessed by pressing the star button. Next, the operator presses a format input button 57 using the wand and moves the wand in turn to points e, f (or Just point g which contains the coordinates of e and f) on the digitizing tablet to define the format or the paper size of the document D. Alternatively, this step may be eliminated if only a standard paper size is used and the LCU is set to default to this standard size. Transducers may be located beneath the sheet to produce signals relating the position of the points touched relative to the registered upper left corner of the sheet. Alternatively, the tablet may be of the known sonic type wherein a spark formed by a wand creates sound waves in the air which are sensed by microphones placed alone the sides of the tablet or wherein a sensor is placed in the wand and sources at known points on the sides of the tablet emit sonic signals (see, for example, U.S. Pat. No. 4,012,588 in the name of Davis et al and U.S. Pat. No. 4,124,838 in the name of Kiss). A digitizer controller 54 knowing the times of emitting of the signals and their receipt can through triangulation principles calculate the location of a point or points on the platen relative to a known point such as the upper-left corner shown.

Next, the operator inputs the desired color for the annotated information appearing in area A by depressing an accent input button 58 and one of the color buttons 61 in the apparatus' menu of available colors and moves the wand to two diagonally opposite points on document D, such as points s,t that define a rectangular area where the annotation is desired. The LCU may also be programmed to receive inputs regarding other geometrical shapes. This information is outputted on the display 55 (FIG. 2) showing the relative position of the area A on the display, indicating the desired color accent for area A, and also illustrates the format of the document sheet D.

Note that some of the input buttons (57, 58, 61) may be associated with the digitizing tablet and actuated using the wand. The digitizer processor 54 knowing the position of these buttons relative to the reference corner also contains a code relative to the identification of that button by its location.

Inputs from the digitizer and the color select buttons are inputted into the LCU through interrupt signal processor 45 and are stored in temporary memory 42.

The operator next takes the document sheet D and places it on the exposure platen (using feeder 15 for example or by direct placement) so that the side to be reproduced faces the exposure lamps and registers the sheet with the appropriate corner (or centers it against a registration edge). The stored program control 46 on the LCU has a program for compensating for the reversal of the sheet vis-a-vis the location of areas when the sheet is face-up versus the location of these areas when the sheet is turned over for exposure. Alternatively, format input may not be needed where the same point on the sheet is registered when the sheet is both face up and face down. For example, where the sheet is registered when face-up using centering of its left edge for digitizing and then inverted for exposure so that the same edge is again centered, the location of the digitized areas is known without need of format input.

In accordance with a program stored in the LCU, the LCU determines the longer of the two dimensions X, Y and in this case it is X, and divides this dimension with the longer of the nominal dimensions of the annoted information as stored in an elementary bit map in character memory and having dimensions a, b with b the longer dimension in this case. The result provides a magnification or scaling factor M for best reproducing the desired annotation in the desired area. The LCU then scales the elementary bit map of each character of the annotated information by the magnification factor and enters same in a page buffer memory 42*a* in a corresponding location relative to the reference corner of the page. The remaining portion of the page memory corresponding to the area outside of area A is filled with digital 1's indicating that during recording, the electrostatic charge on the image frame or frames used to record the annotated information will be erased in those areas outside of that corresponding to area A. Within the page buffer memory of the bit map of area A, digital 0's are provided where no erasure of charge is to be made and digital l's are provided where erasure is to be made so that development of the charged areas on this image frame will record the annotated words.

The LCU may be programmed to compare the orientation of the larger of the two dimensions X, Y to serve as an indicator as to the orientation of printing of the annotation. Thus, if the Y dimension is longer than the X dimension and b>a then the words TOP SECRET may be printed reading vertically.

In response to encoder pulses from encoders 17, 18, the image stored in page memory 42*a* is electronically printed by energizing the LED printhead 82 with the data stored in the bit map on a line by line basis to selectively modulate the electrostatic charge on a suitable image frame or frames to form an electrostatic image of the additional information. The LED printhead 82 comprises a plurality of light emitting diodes (LED's) arranged in a row lying across the width of the web 12. These LED's are coupled to the output drivers 48 of the LCU. A SELFOC (trademark of Nippon Sheet Glass Company, Ltd.) gradient index lens ray (GRIN) 86 is located proximate the web and is also directed transverse to the direction of web movement. The GRIN 86 focuses the light from the LED's onto the surface of the web 12. The LED printhead may be located as shown after the exposure area 30 or more preferably before the exposure area such as opposite roller 5. The important consideration being that it be located between the primary electrostatic charger station 34 and development station 119. Other sources for electronic printing may be used such as laser scanner, etc.

Prior to or as the first image sector on the photoconductive web 12 upon which the image of the annotation is to be formed passes above the GRIN, the LCU in response to signals provided by the data stored in page memory determines which of the LED's to illuminate and the duration of each such exposure to cause the LED to modulate the charge in the area of the image frame corresponding to area A with image information that will reproduce character information in accordance with the additional information selected for reproduction.

This electrostatic image is developed by the appropriate colored development station or stations by the LCU activating one or more of the actuators 40. An exposure of the original document D is made on a separate image frame (or frames if the original is a multicolor original) and such image frame(s) developed with its appropriate developer(s). The two or more image frames are then transferred in register to a copy sheet using transfer roller 68. There is thus provided an annotated reproduction with the annotation appearing in a designated area and being of a designated size without also magnifying the information on the original document.

EXTENSIONS AND MODIFICATIONS

In a highly productive printer the fewer the image frames used for recording, the higher the possible productivity. With this in mind, one image frame may be used to record the annotated information by placing a black patch in the area of the original and designating the size of the patch using the digitizing wand. The annotated data may then be magnified to the dimension of the patch and recorded on the same image frame used to reproduce the original using the LED printhead. In such case, both will be developed in the same color. The page memory in such an example will have digital 0's provided in the area corresponding to that outside of area A so as not to erase charge in the image frame outside of that area used to reproduce the annotated information. This allows the charge outside of that corresponding to the patch area to be exposed at the optical exposure station 30 with the information of document D. See for example Jamali et al U.S. Pat. No. 4,887,128, the contents of which are incorporated herein by this reference.

In still another modification, the LED printhead may be replaced by an electrostatic recording head that is programmed to write in accordance with the teachings expressed herein. The use of such a head, see for example U.S. Pat. No. 3,045,644, allows for recording on the same image frame for single colors of both the additional information and information from the original without use of a black patch.

It is also contemplated by my invention that a reproduction containing an annotation in a color different from that of the original be reproduced using a single image frame wherein, for example, the annotated information is reproduced on a charged image frame that has been selectively discharged so that the information to be reproduced is erased while background remains. This information is then developed using a reversal toner which develops a discharged area and thereafter the optical exposure of the original is made onto the same image frame and developed using a non-reversal toner of a different color.

While the invention has been illustrated with regard to an optical copier, it is also contemplated that the information of the original may be scanned by, say, a CCD reader and the data therefrom electronically merged into the page buffer memory. Where a different color for the annotation is to be provided, there may be provided a separate page memory for electronically printing each color.

Data for providing the annotated information may be input via a magnetic disc, PROM and or by a keyboard input using a suitable terminal.

The illustrated embodiment of a four-color electrophotographic reproduction apparatus is provided as an example apparatus employing three or fewer color stations is contemplated too.

There has been described an improved apparatus for creating annotated reproductions of originals wherein improved control over location and size of the annotation is provided.

While the invention has been described with particular reference to preferred embodiments thereof, it will be understood that variations and modifications can be effected within the spirit and scope of the invention.

I claim:

1. An electrostatographic reproduction apparatus comprising:

means for designating a dimension parameter of an area on an original document to be reproduced with an annotation and generating first signals related to same;

means for storing data to be used to form an annotation;

means responsive to the first signals for determining an orientation of the annotation on a reproduction to be produced of the original document;

means for scaling the data to a size related to the dimension parameter of the area and generating second signals representing same;

an electrostatic recording element;

means for modulating charge on the recording element with image information from an original document to be reproduced;

means responsive to said second signals for modulating charge on the recording element to record the annotated information;

means for developing the information recorded on the recording element; and means for transferring the developed information to a copy sheet to form a reproduction of the original document with an annotation in the area of a size corresponding to a dimension parameter of the area.

2. The apparatus of claim 1 and wherein the means for storing stores data representing a plurality of selectable annotations and means are provided for selecting one of the annotations for reproduction in an area designated on a reproduction of the original.

3. The apparatus of claim 1 and wherein the data represents character information.

4. The apparatus of claim 1 and wherein the data is stored on a PROM.

5. The apparatus of claim 1 and wherein the apparatus includes means for receipt of data from a magnetic disc.

6. The apparatus of claim 1 and including a keyboard for input of the data.

7. The apparatus of claim 1 and including an exposure station for optically exposing an image of the original document onto the recording element.

8. The apparatus of claim 2, 3, 4, 5, 6, or 7 and including means for developing the annotation in a different color than that of a color used to form the reproduction of the information on the original document.

9. The apparatus of claim 1 and including means for storing a bit map of the annotation scaled to that of a dimension parameter of the area.

* * * * *